US011795933B2

(12) United States Patent
Yamanaka et al.

(10) Patent No.: US 11,795,933 B2
(45) Date of Patent: Oct. 24, 2023

(54) PIEZOELECTRIC PUMP HAVING A HEAT-DISSIPATING ARRANGEMENT

(71) Applicant: Murata Manufacturing Co., Ltd., Kyoto (JP)

(72) Inventors: Yoshio Yamanaka, Kyoto (JP); Masahiro Sasaki, Kyoto (JP); Kenjiro Okaguchi, Kyoto (JP); Shinichiro Matsumoto, Kyoto (JP); Shizuka Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 184 days.

(21) Appl. No.: 17/363,912

(22) Filed: Jun. 30, 2021

(65) Prior Publication Data

US 2021/0324851 A1 Oct. 21, 2021

Related U.S. Application Data

(63) Continuation of application No. PCT/JP2020/000663, filed on Jan. 10, 2020.

(30) Foreign Application Priority Data

Mar. 18, 2019 (JP) ..... 2019-049884

(51) Int. Cl.
*F04B 39/06* (2006.01)
*F04B 39/12* (2006.01)
(Continued)

(52) U.S. Cl.
CPC ..... *F04B 45/047* (2013.01); *F04B 39/06* (2013.01); *F04B 39/121* (2013.01);
(Continued)

(58) Field of Classification Search
CPC ..... F04B 39/06; F04B 39/121; F04B 43/04; F04B 43/046; F04B 43/026; F04B 45/047;
(Continued)

(56) References Cited

U.S. PATENT DOCUMENTS 10,356,941 B2 * 7/2019 Xu ..... F04B 45/047
2005/0231914 A1 10/2005 Mikubo et al.
(Continued)

FOREIGN PATENT DOCUMENTS

JP H07-017970 U 3/1995
JP 2001-342964 A 12/2001
(Continued)

OTHER PUBLICATIONS

International Search Report issued in Application No. PCT/JP2020/000663, dated Mar. 17, 2020.
(Continued)

*Primary Examiner* — Charles G Freay
(74) *Attorney, Agent, or Firm* — Pearne & Gordon LLP

(57) ABSTRACT

A pump unit (100) includes a plurality of piezoelectric pumps (1), a flow path-defining member (50), and a heat-dissipating part (60). The plurality of piezoelectric pumps (1) each include a first flow path for sucking and discharging of fluid. The flow path-defining member (50) includes a second flow path for connection to the first flow paths in the plurality of piezoelectric pumps (1). Heat generated in the plurality of piezoelectric pumps (1) is dissipated through the heat-dissipating part (60). The heat-dissipating part (60) is disposed between the flow path-defining member (50) and each of the plurality of piezoelectric pumps (1). The heat-dissipating part (60) has through-holes through which the first flow paths are connected to the second flow path.

17 Claims, 8 Drawing Sheets

(51) Int. Cl.

| | |
|---|---|
| ***F04B 45/047*** | (2006.01) |
| ***F04B 43/04*** | (2006.01) |
| ***F04B 45/04*** | (2006.01) |
| *F04B 53/08* | (2006.01) |

(52) U.S. Cl.
CPC ..... *F04B 43/046* (2013.01); *F04B 45/043* (2013.01); *F04B 53/08* (2013.01)

(58) Field of Classification Search
CPC ..... F04B 45/043; F04B 53/08; F04B 53/16; F04B 19/006
See application file for complete search history.

(56) References Cited

U.S. PATENT DOCUMENTS

| | | | | |
|---|---|---|---|---|
| 2011/0259557 | A1* | 10/2011 | Chao | F04B 43/046 417/413.1 |
| 2012/0301333 | A1 | 11/2012 | Smirnov | |
| 2018/0066650 | A1 | 3/2018 | Fujisaki et al. | |
| 2018/0146574 | A1* | 5/2018 | Chen | H05K 7/20409 |
| 2018/0240734 | A1* | 8/2018 | Liao | H01L 23/36 |

FOREIGN PATENT DOCUMENTS

| | | | |
|---|---|---|---|
| JP | 2004-134742 | A | 4/2004 |
| WO | 2016/175185 | A1 | 11/2016 |

OTHER PUBLICATIONS

Written Opinion issued in Application No. PCT/JP2020/000663, dated Mar. 17, 2020.

* cited by examiner

PIEZOELECTRIC PUMP HAVING A HEAT-DISSIPATING ARRANGEMENT

CROSS REFERENCE TO RELATED APPLICATION

This is a continuation of International Application No. PCT/JP2020/000663 filed on Jan. 10, 2020 which claims priority from Japanese Patent Application No. 2019-049884 filed on Mar. 18, 2019. The contents of these applications are incorporated herein by reference in their entireties.

BACKGROUND OF THE DISCLOSURE

Field of the Disclosure

The present disclosure relates to a pump unit including a plurality of piezoelectric pumps.

Description of the Related Art

Piezoelectric pumps, which are a type of positive displacement pumps, are known. The piezoelectric pumps typically include a pump chamber that is at least partially defined by a vibratory plate, with a piezoelectric element bonded to the vibratory plate. Changes in pressure in the pump chamber enables sucking or discharging of fluid. This is done by applying alternating voltage of a predetermined frequency to the piezoelectric element, which in turn drives the vibratory plate at a resonant frequency.

Such a piezoelectric pump is disclosed in, for example, International Publication No. 2016/175185 (Patent Document 1).

The piezoelectric pump disclosed in Patent Document 1 includes a valve housing, a pump housing, and a diaphragm. A nozzle is provided to the valve housing. The pump housing includes a bottom portion having flow path holes. The diaphragm is sandwiched between the valve housing and the pump housing. The pump housing accommodates a vibratory plate, with a piezoelectric element bonded to the vibratory plate. Gas is sucked through the flow path holes in the bottom portion of the pump housing. Vibrations of the vibratory plate cause the gas sucked through the flow path holes to flow out from the nozzle. Alternatively, the piezoelectric pump may be configured to suck gas through the nozzle and to discharge the gas through the flow path holes.

Patent Document 1: International Publication No. 2016/175185

BRIEF SUMMARY OF THE DISCLOSURE

The pump flow rate achievable with the piezoelectric pump disclosed in Patent Document 1 is limited to a certain extent when the piezoelectric pump is used alone. As a workaround, a plurality of piezoelectric pumps may be connected in parallel to increase the pump flow rate.

Pump housings for accommodating piezoelectric pumps typically have a substantially flat bottom surface. It is thus difficult to connect tubes or the like to flow path holes provided in the bottom surface. It is therefore necessary to address the problem of how to assemble the piezoelectric pumps connected in parallel.

Another problem is how to deal with the heat generated by the vibrations of the vibratory plates of the piezoelectric pumps. The piezoelectric pumps can become defective due to the temperature rise caused by the heat generated under vibration conditions. It is therefore necessary to address the need for good dissipation of the heat from the individual piezoelectric pumps.

The present disclosure therefore has been made in view of the above-mentioned problems, and it is an object of the present disclosure to provide a pump unit that ensures both the ease of assembly of piezoelectric pumps connected in parallel and good dissipation of the heat from the piezoelectric pumps.

A pump unit disclosed herein includes a plurality of piezoelectric pumps, a flow path-defining member, and a heat-dissipating part. The plurality of piezoelectric pumps each include a first flow path for sucking or discharging of fluid. The flow path-defining member includes a second flow path for connection to the first flow paths in the plurality of piezoelectric pumps. The heat generated in the plurality of piezoelectric pumps is dissipated through the heat-dissipating part. The heat-dissipating part is disposed between the flow path-defining member and each of the plurality of piezoelectric pumps. The heat-dissipating part has through-holes through which the first flow paths are connected to the second flow path.

The flow path-defining member of the pump unit disclosed herein may have a first surface and a second surface that face each other. The heat-dissipating part and the plurality of piezoelectric pumps may be disposed on a side on which the first surface is located.

The heat-dissipating part of the pump unit disclosed herein may be constructed of a heat-dissipating plate.

The heat-dissipating part of the pump unit disclosed herein may partially extend beyond a periphery of the flow path-defining member.

The flow path-defining member of the pump unit disclosed herein may include a frame part defining an open part where the flow path-defining member on a side on which the plurality of piezoelectric pumps are located is open. The first surface may be an end face on an end side of the frame part. The heat-dissipating part may be disposed on the first surface in a manner so as to cover the open part and may be fastened to the first surface with a plurality of fastening members.

The frame part in the pump unit disclosed herein may include a plurality of corner portions. The heat-dissipating part is preferably fastened on the plurality of corner portions to the first surface.

The frame part in the pump unit disclosed herein may include: a first side portion having a communication hole through which the second flow path is in communication with the outside of the flow path-defining member; a second side portion facing the first side portion; a third side portion forming a connection between one end of the first side portion and one end of the second side portion; and a fourth side portion forming a connection between the other end of the first end portion and the other end of the second side portion. The second side portion may have a first recess where the midsection of the second side portion is recessed toward the first side portion, and the third side portion may have a second recess where the midsection of the third side portion is recessed toward the fourth side portion. The fourth side portion may have a third recess where the midsection of the fourth side portion is recessed toward the third side portion. The indentation depth of the first recess may be greater than the indentation depth of the second recess and is greater than the indentation depth of the third recess.

The pump unit disclosed herein may further include an auxiliary heat-dissipating part in such a manner that the plurality of piezoelectric pumps are sandwiched between the auxiliary heat-dissipating part and the heat-dissipating part.

The flow path-defining member of the pump unit disclosed herein may have a first surface and a second surface that face each other. The heat-dissipating part may include a first heat-dissipating part disposed on the first surface and a second heat-dissipating part disposed on the second surface. At least one of the plurality of piezoelectric pumps may be disposed on the side on which the first surface is located, and at least one of the plurality of piezoelectric pumps may be disposed on the side on which the second surface is located.

The first heat-dissipating part and the second heat-dissipating part of the pump unit disclosed herein may each be constructed of a heat-dissipating plate.

In the pump unit disclosed herein, the at least one of the plurality of piezoelectric pumps that is disposed on the side on which the first surface is located may face the at least one of the plurality of piezoelectric pumps that is disposed on the side on which the second surface is located.

At least one of the first heat-dissipating part and the second heat-dissipating part of the pump unit disclosed herein may partially extend beyond a periphery of the flow path-defining member.

The flow path-defining member of the pump unit disclosed herein may include a frame part having two end portion sides and having a cavity where both of the end portion sides are open, with the first surface being located on one of the end portion sides and the second surface being located on the other end portion side. The first heat-dissipating part may be disposed on the first surface in a manner so as to cover the cavity on the one end portion side. The second heat-dissipating part may be disposed on the second surface in a manner so as to cover the cavity on the other end portion side. The first heat-dissipating part and the second heat-dissipating part may respectively be fastened to the first surface and the second surface with a plurality of fastening members.

The frame part in the pump unit disclosed herein may include a plurality of corner portions. The first heat-dissipating part and the second heat-dissipating part are preferably fastened on the plurality of corner portions to the first surface and the second surface, respectively.

The frame part in the pump unit disclosed herein may include: a first side portion having a communication hole through which the second flow path is in communication with the outside of the flow path-defining member; a second side portion facing the first side portion; a third side portion forming a connection between one end of the first side portion and one end of the second side portion; and a fourth side portion forming a connection between the other end of the first end portion and the other end of the second side portion. The second side portion may have a first recess where the midsection of the second side portion is recessed toward the first side portion, and the third side portion may have a second recess where the midsection of the third side portion is recessed toward the fourth side portion. The fourth side portion may have a third recess where the midsection of the fourth side portion is recessed toward the third side portion. The indentation depth of the first recess may be greater than the indentation depth of the second recess and is greater than the indentation depth of the third recess.

The pump unit disclosed herein may further include a first auxiliary heat-dissipating part and a second auxiliary heat-dissipating part. The at least one of the plurality of piezoelectric pumps that is disposed on the side on which the first surface is located may be sandwiched between the first auxiliary heat-dissipating part and the first heat-dissipating part. The at least one of the plurality of piezoelectric pumps that is disposed on the side on which the second surface is located may be sandwiched between the second auxiliary heat-dissipating part and the second heat-dissipating part.

The flow path-defining member of the pump unit disclosed herein may have a cut-out in which the heat-dissipating part is exposed in a manner so as to face the flow path-defining member.

The present disclosure provides the pump unit that ensures both the ease of assembly of the piezoelectric pumps connected in parallel and good dissipation of the heat from the piezoelectric pumps.

DETAILED DESCRIPTION OF THE DISCLOSURE

Hereinafter, embodiments of the present disclosure will be described in detail with reference to the accompanying drawings. Note that the same or like parts in the embodiments are denoted by the same reference signs throughout and redundant description thereof will be omitted.

Embodiment 1

Figure 1:
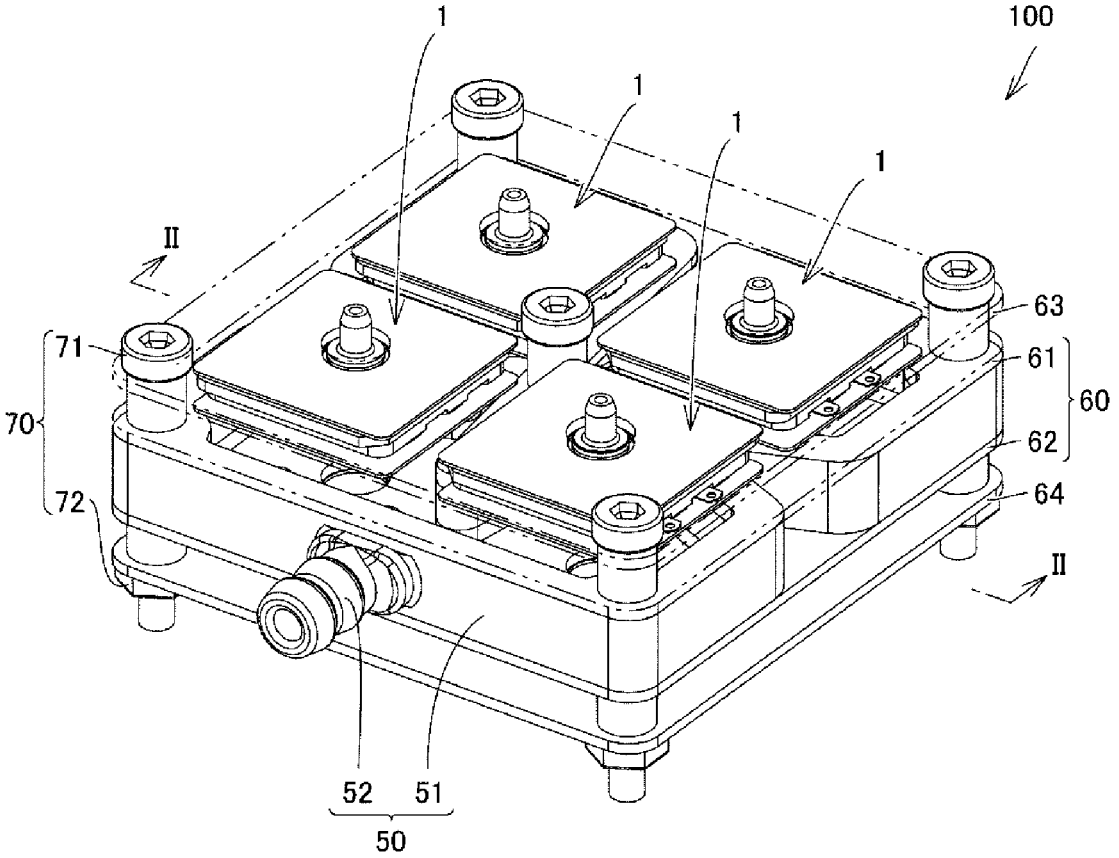
FIG. 1 is a perspective view of a pump unit according to Embodiment 1.
Figure 2:
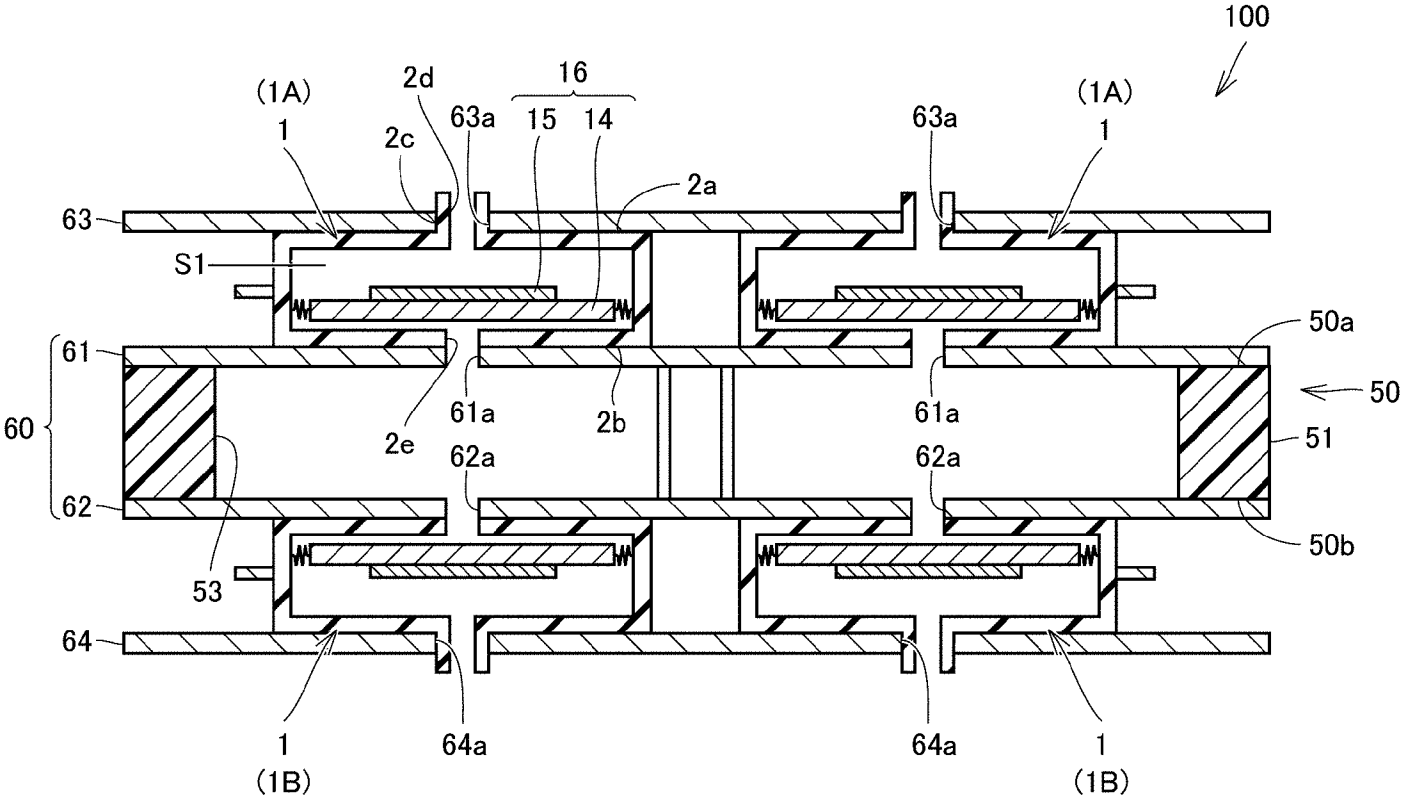
FIG. 2 is a schematic sectional view of the pump unit taken along line II-II in FIG. 1.

FIG. 1 is a perspective view of a pump unit according to Embodiment 1. For convenience, the dash-dot-dot lines in FIG. 1 indicate a first heat-dissipating part 61 and a first auxiliary heat-dissipating part 63, which will be described later. FIG. 2 is a schematic sectional view of the pump unit taken along line II-II in FIG. 1. The following describes a pump unit 100 according to Embodiment 1 with reference to FIGS. 1 and 2.

As illustrated in FIGS. 1 and 2, the pump unit 100 includes a flow path-defining member 50 and piezoelectric pumps 1 assembled to the flow path-defining member 50. The pump unit 100 includes, in addition to the piezoelectric pumps 1 and the flow path-defining member 50, a heat-dissipating part 60, the first auxiliary heat-dissipating part 63, a second auxiliary heat-dissipating part 64, and fastening members 70.

The piezoelectric pumps 1 are each configured to suck or discharge fluid. The piezoelectric pumps 1 each include a housing 2 and a vibration unit 16.

The housing 2 includes a ceiling portion 2*a* and a bottom portion 2*b*, which face each other. The housing 2 is flat and substantially box-shaped. The housing 2 has a first flow path hole 2*d* and second flow path holes 2*e*. More specifically, the first flow path hole 2*d* is provided at a nozzle 2*c*, which is an external connection part protruding through the ceiling portion 2*a*. The second flow path holes 2*e* are provided in the bottom portion 2*b*. The housing 2 has an internal space S1, which functions as a first flow path forming a connection between the first flow path hole 2*d* and the second flow path holes 2*e*. In other words, the piezoelectric pumps 1 each include a first flow path.

The housing 2 accommodates the vibration unit 16. The vibration unit 16 includes a vibratory plate 14 and a piezoelectric element 15. The piezoelectric element 15 is bonded to the vibratory plate 14. The piezoelectric element 15 causes the vibratory plate 14 to vibrate.

More specifically, the piezoelectric element 15 is energized with driving voltage to cause the vibratory plate 14 to vibrate. The vibrations cause pressure fluctuations in the internal space S1, which is the first flow path. Consequently, the fluid sucked through the second flow path holes 2*e* is discharged through the first flow path hole 2*d*. Alternatively, the fluid sucked through the first flow path hole 2*d* may be discharged through the second flow path holes 2*e*. This is done by changing conditions to be met for the vibratory plate 14 to vibrate. The configuration of the piezoelectric pump 1 will be described later in more detail with reference to FIG. 3.

The flow path-defining member 50 includes a frame part 51 and a nozzle part 52. The flow path-defining member 50 has a first surface 50*a* and a second surface 50*b*, which face each other. The first surface 50*a* is located on one of two end portion sides of the frame part 51. The second surface 50*b* is located on the other end portion side of the frame part 51.

The frame part 51 has a cavity 53, where both of the end portion sides are open. Covered with the first heat-dissipating part 61 and a second heat-dissipating part 62, the cavity 53 functions as a second flow path. This will be described later. In other words, the flow path-defining member 50 includes a second flow path. The second flow path is a flow path for connection to the first flow paths in the piezoelectric pumps 1.

The nozzle part 52 is provided to the frame part 51. The nozzle part 52 protrudes from the frame part 51. The nozzle part 52 functions as a communication hole through which the cavity 53 is in communication with the outside of the flow path-defining member 50.

The heat-dissipating part 60 enables the dissipation of the heat from the individual piezoelectric pumps 1. The heat-dissipating part 60 is disposed between the flow path-defining member 50 and each of the piezoelectric pumps 1. The heat-dissipating part 60 has through-holes through which the first flow paths (i.e., the internal spaces S1) are connected to the second flow path (i.e., the cavity 53).

More specifically, the heat-dissipating part 60 includes the first heat-dissipating part 61 and the second heat-dissipating part 62. The first heat-dissipating part 61 and the second heat-dissipating part 62 are each constructed of a heat-dissipating plate. In some embodiments, the first heat-dissipating part 61 and the second heat-dissipating part 62 are each constructed of discrete heat-dissipating plates. The first heat-dissipating part 61 and the second heat-dissipating part 62 may contain thermal grease or the like.

The first heat-dissipating part 61 is disposed on the first surface 50*a* of the flow path-defining member 50. The first heat-dissipating part 61 is disposed on the first surface 50*a* in a manner so as to cover the cavity 53 on the one end portion side of the frame part 51. The first heat-dissipating part 61 is fastened to the first surface 50*a* with the fastening members 70, which will be described later.

The first heat-dissipating part 61 has through-holes 61*a*. The through-holes 61*a* are provided at positions corresponding to the second flow path holes 2*e* of the piezoelectric pumps 1. The through-holes 61*a* each form a connection between the first flow path (i.e., the internal space S1) and the second flow path (i.e., the cavity 53).

The second heat-dissipating part 62 is disposed on the second surface 50*b* of the flow path-defining member 50. The second heat-dissipating part 62 is disposed on the second surface 50*b* in a manner so as to cover the cavity 53 on the other end portion side of the frame part 51. The second heat-dissipating part 62 is fastened to the second surface 50*b* with the fastening members 70, which will be described later.

The second heat-dissipating part 62 has through-holes 62*a*. The through-holes 62*a* are provided at positions corresponding to the second flow path holes 2*e* of the piezoelectric pumps 1. The through-holes 62*a* each form a connection between the first flow path (i.e., the internal space S1) and the second flow path (i.e., the cavity 53).

As the piezoelectric pumps 1, piezoelectric pumps 1A and piezoelectric pumps 1B are provided. The piezoelectric pumps 1A are disposed on the side on which the first surface 50*a* of the flow path-defining member 50 is located. The piezoelectric pumps 1B are disposed on the side on which the second surface 50*b* of the flow path-defining member 50 is located.

Although four piezoelectric pumps 1A and four piezoelectric pumps 1B are provided in Embodiment 1, it is only required that at least one piezoelectric pump 1A and at least one piezoelectric pump 1B be provided.

The piezoelectric pumps 1A are arranged in matrix. The piezoelectric pumps 1A are located in the same plane. More specifically, the piezoelectric pumps 1A are disposed on the first heat-dissipating part 61 in such a manner that the bottom portions 2*b* of the piezoelectric pumps 1A are in contact with the first heat-dissipating part 61. With the piezoelectric pumps 1A being in contact with the first heat-dissipating part 61, the heat generated in the piezoelectric pumps 1A is dissipated through the first heat-dissipating part 61.

The piezoelectric pumps 1B are arranged in matrix. The piezoelectric pumps 1B are located in the same plane. More specifically, the piezoelectric pumps 1B are disposed on the second heat-dissipating part 62 in such a manner that the bottom portions 2*b* of the piezoelectric pumps 1B are in contact with the second heat-dissipating part 62. With the piezoelectric pumps 1B being in contact with the second heat-dissipating part 62, the heat generated in the piezoelectric pumps 1B is dissipated through the second heat-dissipating part 62.

In some embodiments, the piezoelectric pumps 1A and the piezoelectric pumps 1B are arranged in a staggered pattern. The layout of the piezoelectric pumps 1A and the piezoelectric pumps 1B may be changed as appropriate.

As will be described later, at least one of the first heat-dissipating part 61 and the second heat-dissipating part 62 partially extends beyond the periphery of the flow path-defining member 50. In Embodiment 1, the first heat-dissipating part 61 and the second heat-dissipating part 62 each partially extend beyond the periphery of the flow path-defining member 50. This layout results in an increase in the proportion of the area of a contact region where the first heat-dissipating part 61 and the second heat-dissipating part 62 are in contact with outside air. Thus, the heat will be dissipated in an efficient manner.

The use of multiple piezoelectric pumps 1 in particular leads to an increase in the amount of the heat generated. Increasing the proportion of the area of the contact region where the first heat-dissipating part 61 and the second heat-dissipating part 62 are in contact with outside air offers an advantage in that the heat will be dissipated in an efficient manner.

In the case that the piezoelectric pumps 1A face the piezoelectric pumps 1B, there is a higher concentration of heat in a particular site. In this case as well, increasing the proportion of the area of the contact region where the first heat-dissipating part 61 and the second heat-dissipating part 62 are in contact with outside air is advantageous in that the heat will be dissipated in an efficient manner.

The first auxiliary heat-dissipating part 63 is disposed parallel to the first heat-dissipating part 61. The first auxiliary heat-dissipating part 63 is placed on the ceiling portions 2*a* of the piezoelectric pumps 1A. The piezoelectric pumps 1A are sandwiched between the first auxiliary heat-dissipating part 63 and the first heat-dissipating part 61. The piezoelectric pumps 1A are thus stably positioned and securely held. The heat generated in the piezoelectric pumps 1A is in part dissipated through the first auxiliary heat-dissipating part 63, which accelerates the dissipation of the heat accordingly.

The first auxiliary heat-dissipating part 63 has through-holes 63*a*, through which the nozzles 2*c* of the piezoelectric pumps 1A are exposed. With the first auxiliary heat-dissipating part 63 being placed on the ceiling portions 2*a*, the nozzles 2*c* extend through the respective through-holes 63*a*.

The second auxiliary heat-dissipating part 64 is disposed parallel to the second heat-dissipating part 62. The second auxiliary heat-dissipating part 64 is placed on the ceiling portions 2*a* of the piezoelectric pumps 1B. The piezoelectric pumps 1B are sandwiched between the second auxiliary heat-dissipating part 64 and the second heat-dissipating part 62. The piezoelectric pumps 1B are thus stably positioned and securely held. The heat generated in the piezoelectric pumps 1B is in part dissipated through the second auxiliary heat-dissipating part 64, which accelerates the dissipation of the heat accordingly.

The second auxiliary heat-dissipating part 64 has through-holes 64*a*, through which the nozzles 2*c* of the piezoelectric pumps 1B are exposed. With the second auxiliary heat-dissipating part 64 being placed on the ceiling portions 2*a*, the nozzles 2*c* extend through the respective through-holes 64*a*.

The first auxiliary heat-dissipating part 63 and the second auxiliary heat-dissipating part 64 are each constructed of a heat-dissipating plate. In some embodiments, the first auxiliary heat-dissipating part 63 and the second auxiliary heat-dissipating part 64 are each constructed of discrete heat-dissipating plates.

The fastening members 70 each include a bolt 71 and a nut 72. The bolt 71 is inserted from one side in an alignment direction in which the first auxiliary heat-dissipating part 63, the first heat-dissipating part 61, the frame part 51, the second heat-dissipating part 62, and the second auxiliary heat-dissipating part 64 are aligned. The bolt 71 extends through the first auxiliary heat-dissipating part 63, the first heat-dissipating part 61, the frame part 51, the second heat-dissipating part 62, and the second auxiliary heat-dissipating part 64. On the other side in the alignment direction, the nut 72 is screwed on a tip of the bolt 71. The nut 72 is then tightened securely. In this way, the first auxiliary heat-dissipating part 63, the first heat-dissipating part 61, the second heat-dissipating part 62, and the second auxiliary heat-dissipating part 64 are fastened to the frame part 51. The piezoelectric pumps 1A are sandwiched between the first auxiliary heat-dissipating part 63 and the first heat-dissipating part 61, and the piezoelectric pumps 1B are sandwiched between the second auxiliary heat-dissipating part 64 and the second heat-dissipating part 62.

Figure 3:
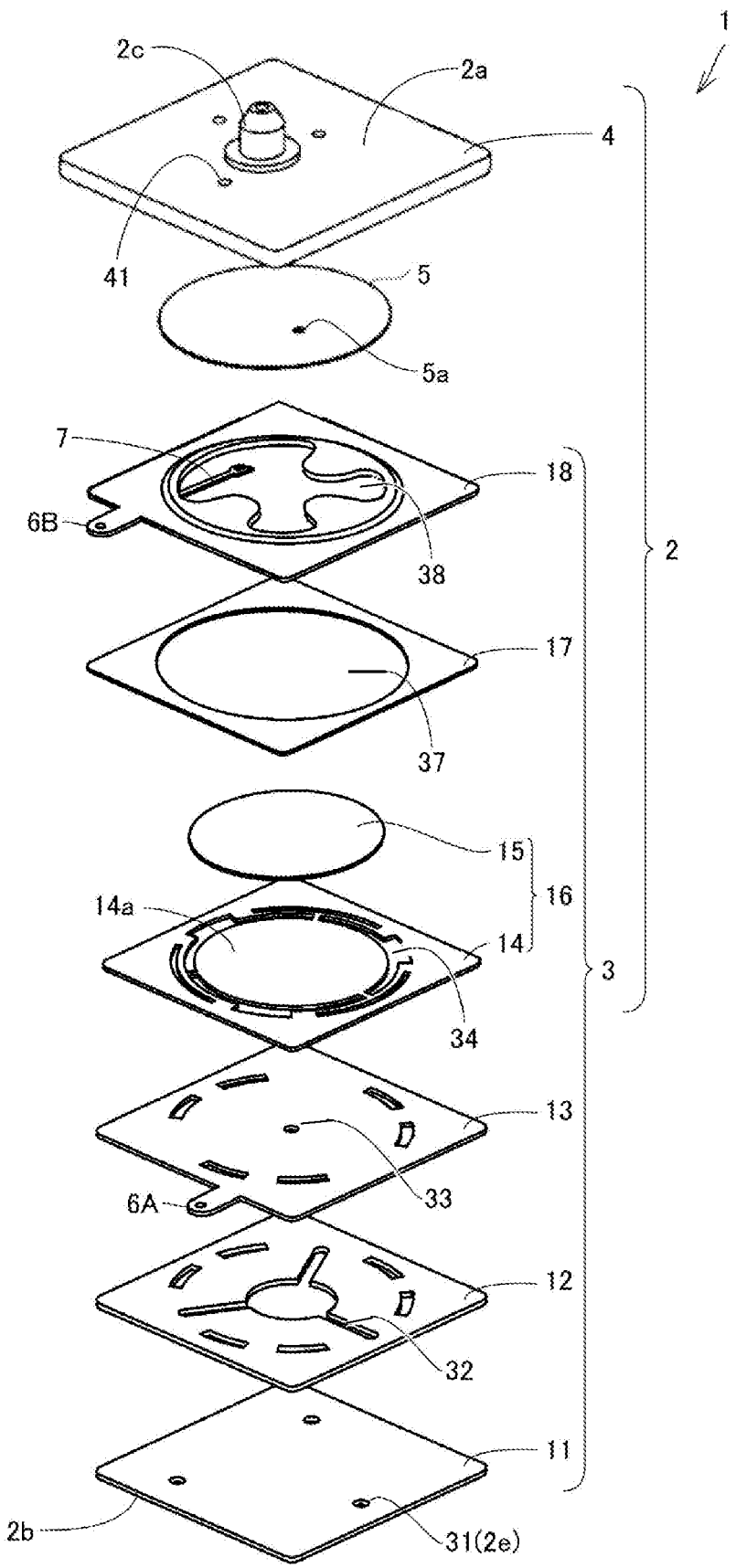
FIG. 3 is an exploded perspective view of a piezoelectric pump in Embodiment 1.

FIG. 3 is an exploded perspective view of a piezoelectric pump in Embodiment 1. The following describes a piezoelectric pump 1 according to Embodiment 1 with reference to FIG. 3.

The piezoelectric pump 1 includes a cover plate 11, a flow path plate 12, a facing plate 13, the vibratory plate 14, the piezoelectric element 15, an insulating plate 17, a feeder plate 18, a diaphragm 5, and a valve housing 4, which are stacked on top of one another in the stated order. The direction from the cover plate 10 to the valve housing 4 is hereinafter referred to as an upward direction, and the direction from the valve housing 4 to the cover plate 11 is hereinafter referred to as a downward direction.

The housing 2 of the piezoelectric pump 1 is composed of a pump housing 3 and the valve housing 4. The pump housing 3 includes the cover plate 11, the flow path plate 12, the facing plate 13, the vibratory plate 14, the piezoelectric element 15, the insulating plate 17, and the feeder plate 18, which are stacked on top of one another in the stated order.

The cover plate 11 has flow path holes 31 (i.e., the second flow path holes 2*e*). The flow path plate 12 has a flow path hole 32, which is in communication with the flow path holes 31. The facing plate 13 has a flow path hole 33, which is in communication with the flow path hole 32. The facing plate 13 is provided with an external connection terminal 6A.

The vibratory plate 14 has a flow path hole 34, which is in communication with the flow path hole 33. The vibratory plate 14 includes a vibratory portion 14*a*, which is located within the flow path hole 34. The flow path hole 34 is circular, and the vibratory portion 14*a* is discoid. The vibratory portion 14*a* is designed to vibrate.

The piezoelectric element 15 is discoid. The piezoelectric element 15 has a lower surface, which is in contact with the vibratory portion 14*a* and is connected to the external connection terminal 6A through the facing plate 13. The piezoelectric element 15 has an upper surface, which is in contact with an internal connection terminal 7 as will be described later and is connected to an external connection terminal 6B through the feeder plate 18. Voltage is applied between the external connection terminals 6A and 6B, and consequently, the piezoelectric element 15 is energized with driving voltage and causes the vibratory portion 14*a* to vibrate.

The insulating plate 17 provides electrical isolation between the vibratory plate 14 and the feeder plate 18. The insulating plate 17 has a flow path hole 37, which is circular and is in communication with the flow path hole 34. The piezoelectric element 15 is exposed upward through the flow path hole 37.

The feeder plate 18 has a flow path hole 38. The feeder plate 18 is provided with the internal connection terminal 7 and the external connection terminal 6B. The internal connection terminal 7 extends inward in the flow path hole 38, and the external connection terminal 6B extends outward.

The diaphragm 5 is flexible and is in the form of a flat membrane. The diaphragm 5 is sandwiched between the pump housing 3 and the valve housing 4. The fluid transferred from the pump housing 3 to the valve housing 4 is kept from flowing back to the pump housing 3 by the diaphragm 5. The diaphragm 5 has a hole 5*a*.

The valve housing 4 is an upper part of the piezoelectric pump 1. The valve housing 4 is provided with the nozzle 2*c*.

The flow path holes 32, 33, 34, 37, and 38 are in communication with each other such that an internal space is defined within the pump housing 3. An internal space defined within the valve housing 4 and the internal space defined within the pump housing 3 constitute the internal space S1 in the housing 2.

As mentioned above, the piezoelectric element 15 is energized with driving voltage. This causes pressure fluctuations in the internal space defined within the pump housing 3 such that the fluid in the pump housing 3 flows to the valve housing 4. As the fluid flows, the midsection of the diaphragm 5 is subjected to the pressure exerted in the direction from the pump housing 3 to the valve housing 4. Consequently, the hole 5*a* is separated from the feeder plate 18, and the internal space defined within the valve housing 4 and the internal space defined within the pump housing 3 are brought into communication with each other through the hole 5*a*. The diaphragm 5 comes into contact with holes 41 of the valve housing 4 and blocks the holes 41 accordingly. As a result, the fluid brought to the internal space defined within the valve housing 4 is discharged through the nozzle 2*c*.

If the fluid flows backward from the valve housing 4 to the pump housing 3, the diaphragm 5 is subjected to the pressure exerted toward the pump housing 3. Under the pressure, the hole 5*a* comes into contact with the feeder plate 18, and the diaphragm 5 is separated from the holes 41. This provides isolation between the internal space defined within the valve housing 4 and the internal space defined within the pump housing 3, and consequently, the backflow of fluid is discharged through the holes 41. The first auxiliary heat-dissipating part 63 and the second auxiliary heat-dissipating part 64 each have through-holes that are provided at positions corresponding to the holes 41. The fluid discharged through the holes 41 flows through the through-holes to get out of the pump unit 100.

Figure 4:
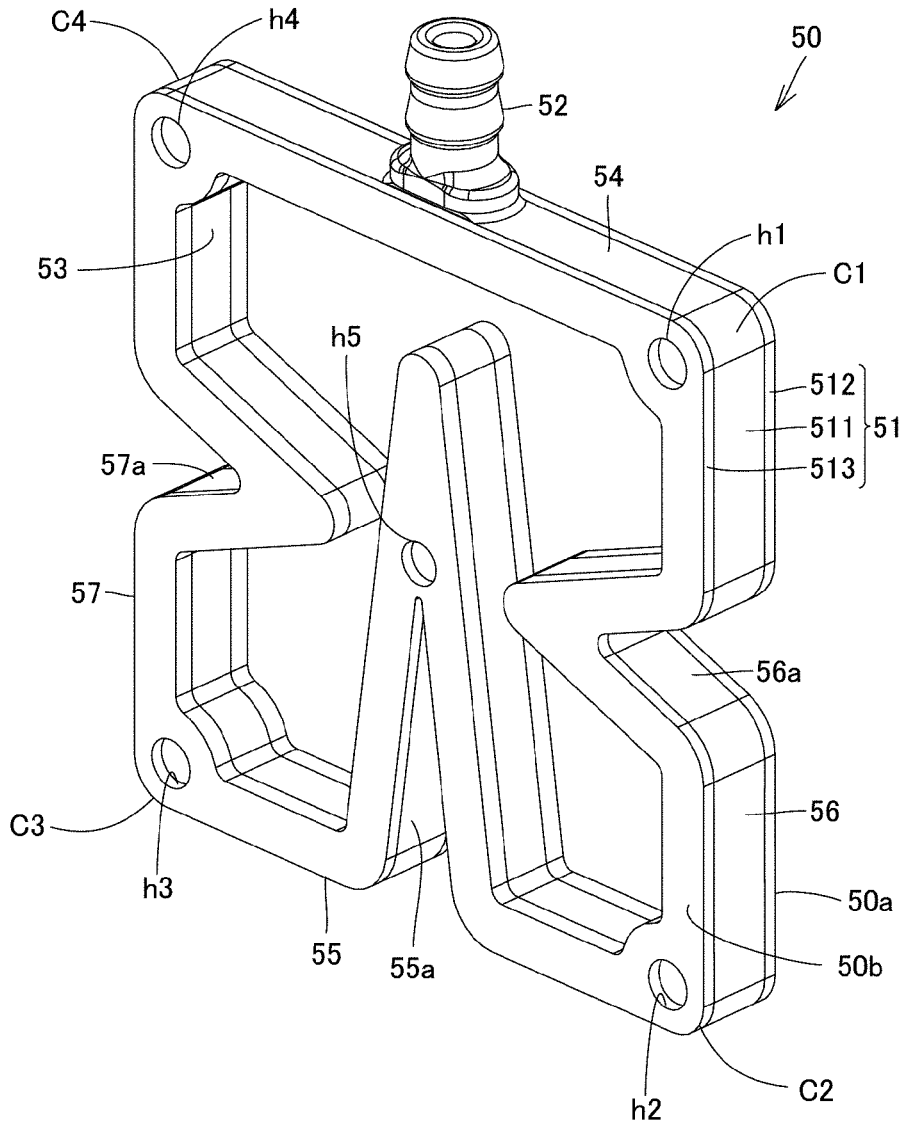
FIG. 4 is a perspective view of a flow path-defining member in Embodiment 1.

FIG. 4 is a perspective view of a flow path-defining member in Embodiment 1. The following describes the flow path-defining member 50 in Embodiment 1 with reference to FIG. 4.

As illustrated in FIG. 4, the frame part 51 of the flow path-defining member 50 includes a first side portion 54, a second side portion 55, a third side portion 56, and a fourth side portion 57. The first side portion 54 is provided with the nozzle part 52, which is a communication part through which the second flow path (i.e., the cavity 53) is in communication with the outside of the flow path-defining member 50. The first side portion 54 is substantially straight. The nozzle part 52 is provided to the midsection of the first side portion 54.

The second side portion 55 faces the first side portion 54. The second side portion 55 has a first recess 55*a*, where the midsection of the second side portion 55 is recessed toward the first side portion 54.

The third side portion 56 forms a connection between one end of the first side portion 54 and one end of the second side portion 55. The third side portion 56 has a second recess 56*a*, where the midsection of the third side portion 56 is recessed toward the fourth side portion 57.

The fourth side portion 57 forms a connection between the other end of the first side portion 54 and the other end of the second side portion 55. The fourth side portion 57 faces the third side portion 56. The fourth side portion 57 has a third recess 57*a*, where the midsection of the fourth side portion 57 is recessed toward the third side portion 56.

With the first recess 55*a*, the second recess 56*a*, and the third recess 57*a* being provided, the first heat-dissipating part 61 and the second heat-dissipating part 62 each partially extend beyond the periphery of the flow path-defining member 50 as described above.

The indentation depth of the first recess 55*a* is greater than the indentation depth of the second recess 56*a* and is greater than the indentation depth of the third recess 57*a*. The space in the frame part 51 is reduced in such a manner as to be divided into two sections, one of which is adjacent to the third side portion 56 and the other one of which is adjacent to the fourth side portion 57. The second recess 56*a* and the third recess 57*a* provided in the respective sections enable further reductions in the space adjacent to the third side portion 56 and the space adjacent to the fourth side portion 57. The volumetric capacity of the second flow path in the flow path-defining member 50 is reduced correspondingly, which enables the pump unit to suck or discharge fluid more responsively.

The frame part 51 has corner portions, which are denoted by C1, C2, C3, and C4, respectively. The corner portion C1 is a place where the first side portion 54 is joined to the third side portion 56. The corner portion C2 is a place where the third side portion 56 is joined to the second side portion 55. The corner portion C3 is a place where the second side portion 55 is joined to the fourth side portion 57. The corner portion C4 is a place where the fourth side portion 57 is joined to the first side portion 54.

The first heat-dissipating part 61 is fastened on at least the corner portions C1, C2, C3, and C4 to the first surface 50*a* with the fastening members 70. The second heat-dissipating part 62 is fastened on at least the corner portions C1, C2, C3, and C4, to the second surface 50*b* with the fastening members 70.

More specifically, the corner portions C1, C2, C3, and C4 have their respective through-holes, which are denoted by h1, h2, h3, and h4.

The first heat-dissipating part 61, the second heat-dissipating part 62, the first auxiliary heat-dissipating part 63, and the second auxiliary heat-dissipating part 64 each have through-holes that are provided at positions corresponding to the through-holes h1, h2, h3, h4.

With the first auxiliary heat-dissipating part 63, the first heat-dissipating part 61, the frame part 51, the second heat-dissipating part 62, and the second auxiliary heat-dissipating part 64 being stacked on top of one another, the bolts 71 are inserted into the through-holes, and the nuts 72 are then screwed onto the tips of the bolts 71 and tightened securely. On the corner portions C1, C2, C3, and C4, the first auxiliary heat-dissipating part 63, the first heat-dissipating part 61, the second heat-dissipating part 62, and the second auxiliary heat-dissipating part 64 are fastened to the frame part 51 accordingly.

The fastening of the first heat-dissipating part 61 and the second heat-dissipating part 62 to the corner portions C1, C2, C3, and C4 of the frame part 51 enhances the adhesion of the first heat-dissipating part 61 and the second heat-dissipating part 62 to the frame part 51. This structure ensures that the cavity 53 of the frame part 51 is airtight when the cavity 53 is blocked by the first heat-dissipating part 61 and the second heat-dissipating part 62.

The frame part 51 includes a main body portion 511, a seal portion 512, and a seal portion 513. The seal portion 512 is located on an upper surface of the main body portion 511, and the seal portion 513 is located on a lower surface of the main body portion 511. The main body portion 511 is a resin member that ensures adequate stiffness. The seal portions 512 and 513 enhance the adhesion between the first heat-dissipating part 61 and the frame part 51 and the adhesion between the second heat-dissipating part 62 and the frame part 51. This structure further ensures that the cavity 53 of the frame part 51 is airtight when the cavity 53 is blocked by the first heat-dissipating part 61 and the second heat-dissipating part 62. The seal portions 512 and 513 may each be an elastically deformable sheet member or a rubber member such as a gasket.

In Embodiment 1, the first recess 55*a* may have a through-hole h5 such that the first heat-dissipating part 61 and the second heat-dissipating part 62 are fastened not only to the corner portions C1, C2, C3, and C4 but also to the first recess 55*a*. The adhesion between the first heat-dissipating part 61 and the frame part 51 and the adhesion between the second heat-dissipating part 62 and the frame part 51 are further enhanced accordingly. This structure further ensures that the cavity 53 is airtight.

The piezoelectric pumps 1 of the pump unit 100 according to Embodiment 1 are assembled to the flow path-defining member 50 in such a manner that the heat-dissipating part 60 is located between the flow path-defining member 50 and each of the piezoelectric pumps 1 as described above. The heat-dissipating part 60 has through-holes through which the second flow path in the flow path-defining member 50 is connected to the first flow paths of the piezoelectric pumps 1.

The piezoelectric pumps 1 are thus assembled to the flow path-defining member 50 in such a way as to ensure that flow paths over which fluid flows are provided. With the heat-dissipating part 60 being disposed between the flow path-defining member 50 and each of the piezoelectric pumps 1, the heat generated in the individual piezoelectric pumps 1 is dissipated through the heat-dissipating part 60.

The pump unit 100 according to Embodiment 1 thus ensures both the ease of assembly of the piezoelectric pumps 1 and good dissipation of the heat from the piezoelectric pumps 1.

Embodiment 2

Figure 5:
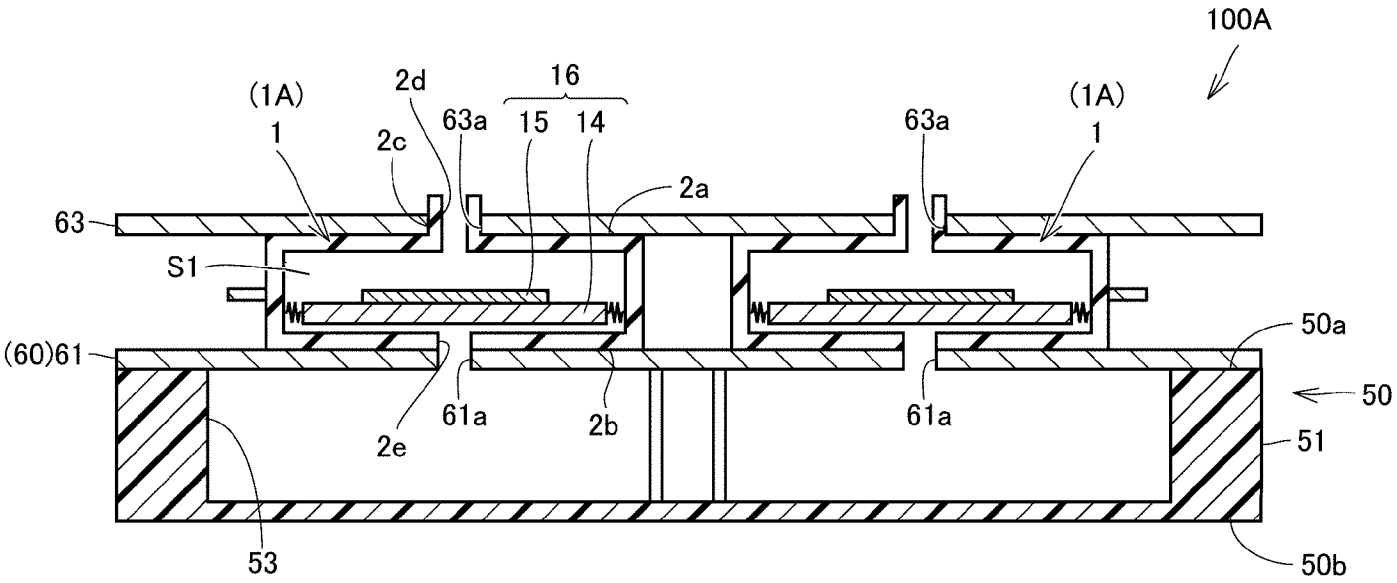
FIG. 5 is a schematic sectional view of a pump unit according to Embodiment 2.

FIG. 5 is a schematic sectional view of a pump unit according to Embodiment 2. The following describes a pump unit 100A according to Embodiment 2 with reference to FIG. 5.

The pump unit 100A according to Embodiment 2, which is illustrated in FIG. 5, differs from the pump unit 100 according to Embodiment 1 mainly in that the piezoelectric pumps 1 are disposed on only the side on which the first surface 50*a* is located, with the cavity 53 being closed on the second surface 50*b* of the flow path-defining member 50. Thus, the pump unit 100A according to Embodiment 2 does not include the second heat-dissipating part 62 and the second auxiliary heat-dissipating part 64. Embodiment 2 is otherwise substantially identical to Embodiment 1 and will not be further elaborated here.

This configuration enables the pump unit 100A according to Embodiment 2 to produce effects substantially equivalent to the effects produced by the pump unit 100 according to Embodiment 1.

Embodiment 3

Figure 6:
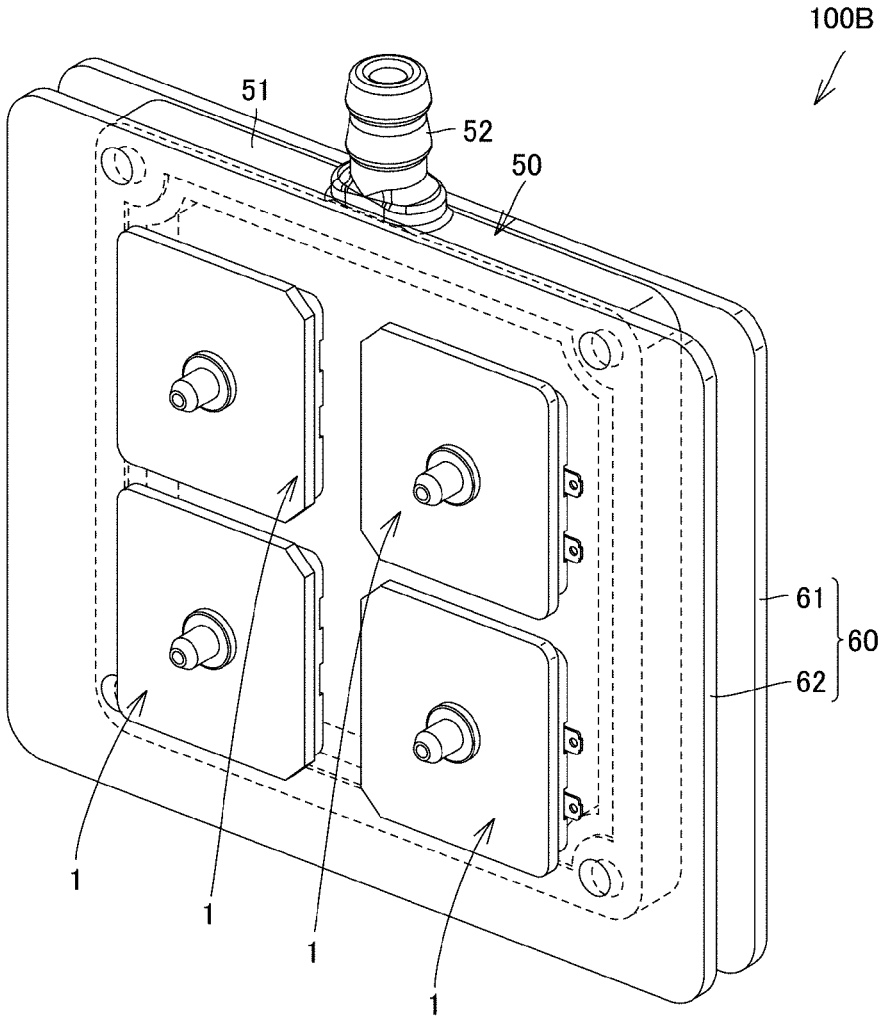
FIG. 6 is a perspective view of a pump unit according to Embodiment 3.

FIG. 6 is a perspective view of a pump unit according to Embodiment 3. Although the first auxiliary heat-dissipating part 63, the second auxiliary heat-dissipating part 64, and the fastening members 70 are included as in Embodiment 1, these components are omitted from FIG. 6 for convenience. The following describes a pump unit 100B according to Embodiment 3 with reference to FIG. 6.

The differences between the pump unit 100B according to Embodiment 3, which is illustrated in FIG. 6, and the pump unit 100 according to Embodiment 1 are in the size and shape of the flow path-defining member 50. Embodiment 3 is otherwise substantially identical to Embodiment 1.

Unlike the frame part 51 of the flow path-defining member 50 in Embodiment 1, the frame part 51 of the flow path-defining member 50 in Embodiment 3 does not have recesses and is thus in the form of a rectangular frame. When the frame part 51 is viewed in the direction of the central axis of the frame part 51, the outside diameter of the frame part 51 is smaller than the outside diameter of the heat-dissipating part 60. That is, the width of the frame part 51 in Embodiment 2 is smaller than the width of the frame part 51 in Embodiment 1. Thus, the first heat-dissipating part 61 and the second heat-dissipating part 62 each partially extend beyond the periphery of the frame part 51.

This configuration enables the pump unit 100B according to Embodiment 3 to produce effects substantially equivalent to the effects produced by the pump unit according to Embodiment 1.

Embodiment 4

Figure 7:
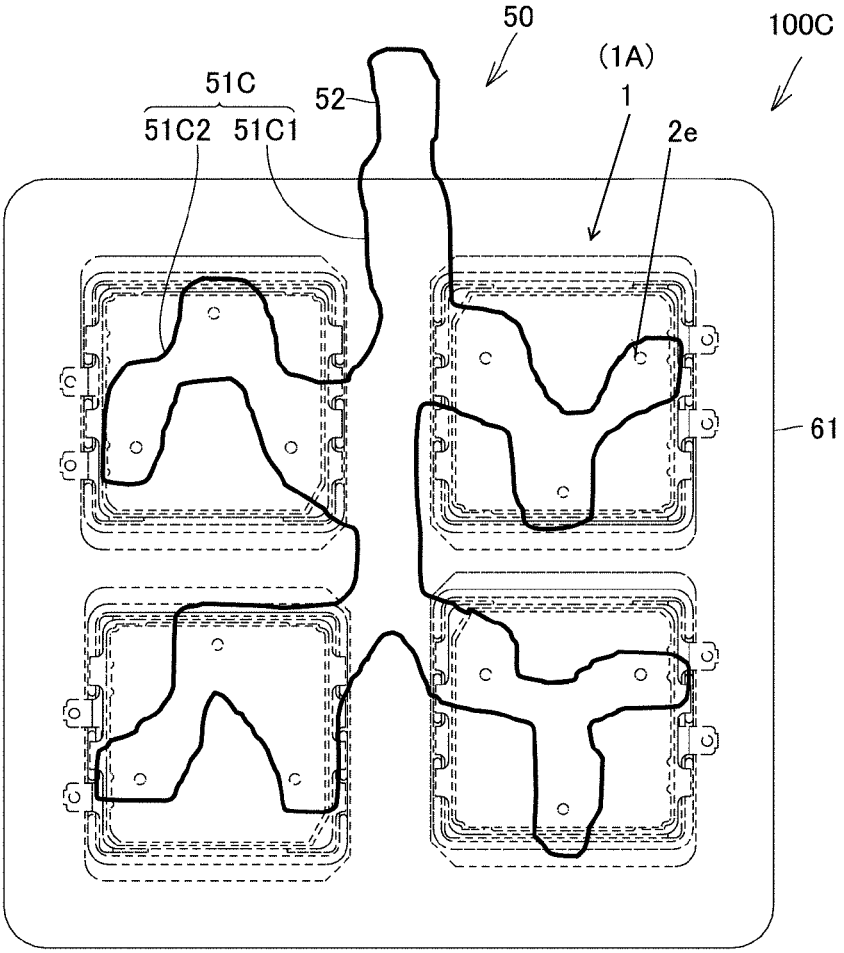
FIG. 7 is a plan view of part of a pump unit according to Embodiment 4.

FIG. 7 is a plan view of part of a pump unit according to Embodiment 4. With the flow path-defining member 50, the piezoelectric pumps 1, and the first heat-dissipating part 61 being assembled, a pump unit 100C viewed in plan from the side on which the flow path-defining member 50 is disposed is illustrated in FIG. 7. The following describes the pump unit 100C according to Embodiment 4 with reference to FIG. 7.

The difference between the pump unit 100C according to Embodiment 4, which is illustrated in FIG. 7, and the pump unit 100 according to Embodiment 1 is in the shape of the frame part of the flow path-defining member 50. The frame part of the flow path-defining member 50 in Embodiment 4 is denoted by 51C. Embodiment 4 is otherwise substantially identical to Embodiment 1.

The frame part 51C includes a trunk portion 51C1 and branch portions 51C2. The trunk portion 51C1 extends substantially straight in a manner so as to overlap the midsection of the first heat-dissipating part 61. The branch portions 51C2 are connectable to the second flow path holes 2*e* of the piezoelectric pumps 1.

This configuration enables the pump unit 100C according to Embodiment 4 to produce effects substantially equivalent to the effects produced by the pump unit according to Embodiment 1. The volumetric capacity of the second flow path in the flow path-defining member 50 is reduced, which enables the pump unit to suck or discharge the fluid more responsively.

Embodiment 5

Figure 8:
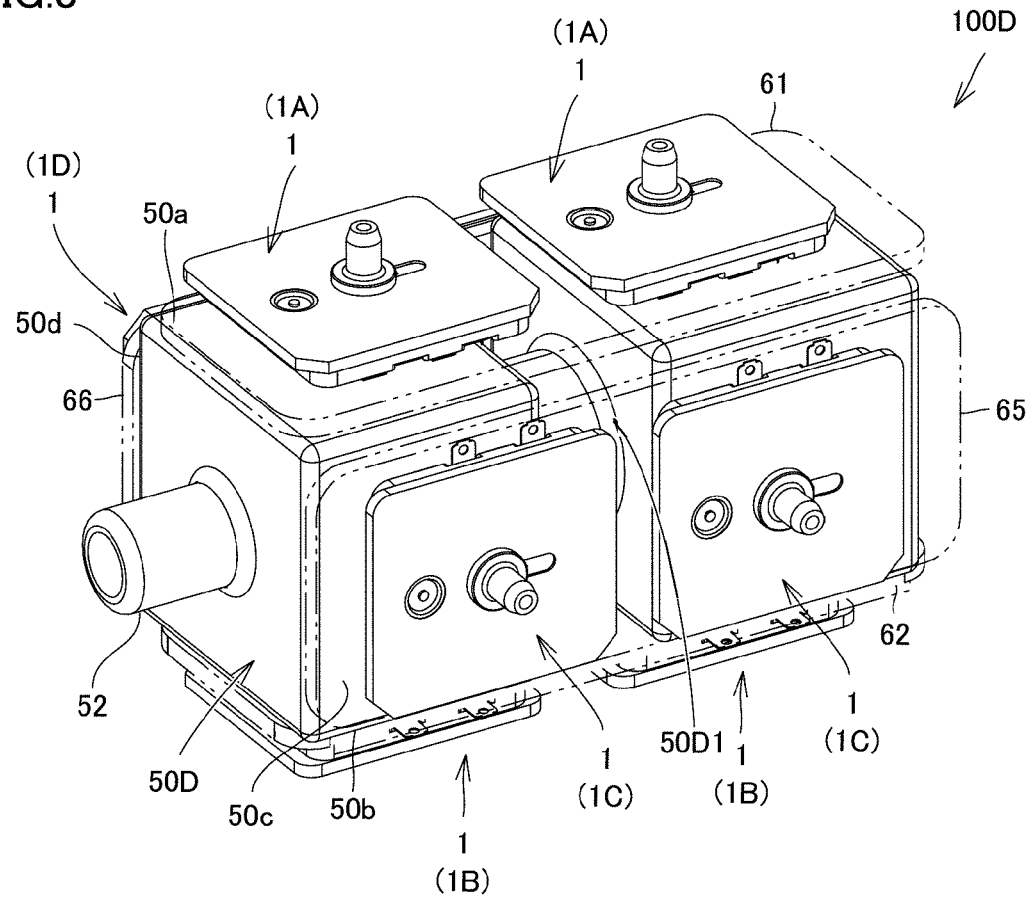
FIG. 8 is a perspective view of a pump unit according to Embodiment 5.

FIG. 8 is a perspective view of a pump unit according to Embodiment 5. For convenience, the dash-dot-dot lines in FIG. 8 indicate the first heat-dissipating part 61, the second heat-dissipating part 62, a third heat-dissipating part 65, and a fourth heat-dissipating part 66, which will be described later. The following describes a pump unit 100D according to Embodiment 5 with reference to FIG. 8.

The differences between the pump unit 100D according to Embodiment 5, which is illustrated in FIG. 8, and the pump unit 100 according to Embodiment 1 are mainly in the shape of the flow path-defining member, the layout of the piezoelectric pumps 1, and the configuration of the heat-dissipating part. The flow path-defining member and the heat-dissipating part in Embodiment 5 are denoted by 50D and 60D, respectively. The pump unit 100D according to Embodiment 5 also differs from the pump unit 100 according to Embodiment 1 in that no auxiliary heat-dissipating part is provided.

The flow path-defining member 50D in Embodiment 5 is in the form of a hollow block. The flow path-defining member 50D is substantially cuboid and has a space therein. The space is the second flow path. The space is in communication with the nozzle part 52.

The flow path-defining member 50D has a first surface 50*a*, a second surface 50*b*, a third surface 50*c*, and a fourth surface 50*d*. The first surface 50*a* and the second surface 50*b* face each other in a first direction. The third surface 50*c* and the fourth surface 50*d* face each other in a second direction orthogonal to the first direction.

The pump unit 100D includes a heat-dissipating part 60D, which is constituted of the first heat-dissipating part 61, the second heat-dissipating part 62, a third heat-dissipating part 65, and a fourth heat-dissipating part 66.

The first heat-dissipating part 61, the second heat-dissipating part 62, the third heat-dissipating part 65, and the fourth heat-dissipating part 66 may each be constructed of a heat-dissipating plate. The first heat-dissipating part 61 is disposed on the first surface 50*a*. The second heat-dissipating part 62 is disposed on the second surface 50*b*. The third heat-dissipating part 65 is disposed on the third surface 50*c*. The fourth heat-dissipating part 66 is disposed on the fourth surface 50*d*.

As the piezoelectric pumps 1, piezoelectric pumps 1A, piezoelectric pumps 1B, piezoelectric pumps 1C, and piezoelectric pumps 1D are provided. More specifically, two piezoelectric pumps 1A, two piezoelectric pumps 1B, two piezoelectric pumps 1C, and two piezoelectric pumps 1D are provided. Alternatively, one piezoelectric pump 1A, one piezoelectric pump 1B, one piezoelectric pump 1C, and one piezoelectric pump 1D may be provided. Still alternatively, three or more piezoelectric pumps 1A, three or more piezoelectric pumps 1B, three or more piezoelectric pumps 1C, and three or more piezoelectric pumps 1D may be provided.

The piezoelectric pumps 1A are disposed on the side on which the first surface 50*a* is located. The piezoelectric pumps 1B are disposed on the side on which the second surface 50*b* is located. The piezoelectric pumps 1C are disposed on the side on which the third surface 50*c* is located. The piezoelectric pumps 1D are disposed on the side on which the fourth surface 50*d* is located.

The piezoelectric pumps 1A are fixed with, for example, a thermally conductive adhesive to the first heat-dissipating part 61. The piezoelectric pumps 1B are fixed with, for example, a thermally conductive adhesive to the second heat-dissipating part 62. The piezoelectric pumps 1C are fixed with, for example, a thermally conductive adhesive to the third heat-dissipating part 65. The piezoelectric pumps 1D are fixed with, for example, a thermally conductive adhesive to the fourth heat-dissipating part 66.

The first surface 50*a*, the second surface 50*b*, the third surface 50*c*, and the fourth surface 50*d* each have through-holes. The through-holes in the first surface 50*a* are provided at positions corresponding to the second flow path holes 2*e* of the piezoelectric pumps 1A. The through-holes in the second surface 50*b* are provided at positions corresponding to the second flow path holes 2*e* of the piezoelectric pumps 1B. The through-holes in the third surface 50*c* are provided at positions corresponding to the second flow path holes 2*e* of the piezoelectric pumps 1C. The through-holes in the fourth surface 50*d* are provided at positions corresponding to the second flow path holes 2*e* of the piezoelectric pumps 1D. Similarly, the first heat-dissipating part 61, the second heat-dissipating part 62, the third heat-dissipating part 65, and the fourth heat-dissipating part 66 each have through-holes. The through-holes of the first heat-dissipating part 61 are provided at positions corresponding to the second flow path holes 2*e* of the piezoelectric pumps 1A. The through-holes of the second heat-dissipating part 62 are provided at positions corresponding to the second flow path holes 2*e* of the piezoelectric pumps 1B. The through-holes of the third heat-dissipating part 65 are provided at positions corresponding to the second flow path holes 2*e* of the piezoelectric pumps 1C. The through-holes of the fourth heat-dissipating part 66 are provided at positions corresponding to the second flow path holes 2*e* of the piezoelectric pumps 1D.

The space (i.e., the second flow path) in the flow path-defining member 50D is connected to the internal spaces (i.e., the first flow paths) in the respective piezoelectric pumps 1 through the through-holes of the first heat-dissipating part 61, the through-holes of the second heat-dissipating part 62, the through-holes of the third heat-dissipating part 65, and the through-holes of the fourth heat-dissipating part 66.

The flow path-defining member 50D has a cut-out 50D1, in which the heat-dissipating part 60D (i.e., the first heat-dissipating part 61, the second heat-dissipating part 62, the third heat-dissipating part 65, and the fourth heat-dissipating part 66) is exposed in a manner so as to face the flow path-defining member 50D. That is, a clearance is created between the flow path-defining member 50D and the heat-dissipating part 60D, which is partially exposed accordingly.

This configuration enables the pump unit 100D according to Embodiment 5 to produce effects substantially equivalent to the effects produced by the pump unit 100 according to Embodiment 1. With a greater number of piezoelectric pumps 1 being incorporated in the pump unit 100D according to Embodiment 5, the suction capability or the discharge capability of the pump unit 100D is improved correspondingly.

Although the flow path-defining member 50 in Embodiment 5 is in the form of a hollow block, the flow path-defining member 50 may be in the form of a hollow prism in which the second flow path is defined. The pump unit according to Embodiment 5 may further include more than one auxiliary heat-dissipating part.

It is originally intended to combine the features of the above-described embodiments as appropriate. For example, each auxiliary heat-dissipating part in Embodiments 1 to 4 may be omitted as in Embodiment 5. An adhesive or the like may be used in place of the fastening members 70 in Embodiments 1 to 4 without departing from the spirit of the present disclosure.

The above-described pump unit according to any one of Embodiments 1 to 5 may, for example, be used as an aspirator for oral care. The use of the pump unit is not limited to such an aspirator for oral care. The pump unit may be used as a pump for discharging or sucking fluid.

The presently disclosed embodiments are illustrative and not restrictive in all respects. The scope of the present disclosure is defined by the appended claims, and all modifications and alterations within the meaning and scope of the claims or the equivalence thereof are therefore embraced by the present disclosure.

1, 1A, 1B, 1C, 1D piezoelectric pump
2 housing
2*a* ceiling portion
2*b* bottom portion
2*c* nozzle
2*d* first flow path hole
2*e* second flow path hole
3 pump housing
4 valve housing
5 diaphragm
5*a* hole
6A, 6B external connection terminal
7 internal connection terminal
11 cover plate
12 flow path plate
13 facing plate
14 vibratory plate
14*a* vibratory portion
15 piezoelectric element
16 vibration unit
17 insulating plate
18 feeder plate
31, 32, 33, 34, 37, 38 flow path hole
41 hole
50, 50D flow path-defining member
50D1 cut-out
50*a* first surface
50*b* second surface
50*c* third surface
50*d* fourth surface
51, 51C frame part
51C1 trunk portion
51C2 branch portion
52 nozzle part
53 cavity
54 first side portion
55 second side portion
55*a* first recess
56 third side portion
56*a* second recess
57 fourth side portion
57*a* third recess
60, 60D heat-dissipating part
61 first heat-dissipating part
61*a*, 62*a* through-hole
62 second heat-dissipating part
63 first auxiliary heat-dissipating part
64 second auxiliary heat-dissipating part
65 third heat-dissipating part
66 fourth heat-dissipating part
70 fastening member
71 bolt
72 nut
100, 100A, 100B, 100C, 100D pump unit
511 main body portion
512, 513 seal portion

The invention claimed is:

1. A pump unit comprising:
a first plurality of piezoelectric pumps each including a first flow path for sucking or discharging of fluid;
a flow path-defining member including a second flow path for connection to the first flow paths; and
a heat-dissipating plate for dissipating heat generated in the first plurality of piezoelectric pumps, wherein
the heat-dissipating plate is disposed between the flow path-defining member and each of the first plurality of piezoelectric pumps, and
the heat-dissipating plate has through-holes, and the first flow paths are connected to the second flow path through the through-holes.

2. The pump unit according to claim 1, wherein
the flow path-defining member has a first surface and a second surface facing each other, and
the heat-dissipating plate and the first plurality of piezoelectric pumps are disposed on a side on which the first surface is located.

3. The pump unit according to claim 2, wherein the heat-dissipating plate partially extends beyond a periphery of the flow path-defining member.

4. The pump unit according to claim 2, wherein
the flow path-defining member includes a frame part defining an open part, wherein the open part is opened toward a side on which the first plurality of piezoelectric pumps are located,
the first surface is an end face on an end side of the frame part, and
the heat-dissipating plate is disposed on the first surface in a manner so as to cover the open part and is fastened to the first surface with a plurality of fastening members.

5. The pump unit according to claim 4, wherein
the frame part includes a plurality of corner portions, and
the heat-dissipating plate is fastened on the plurality of corner portions to the first surface.

6. The pump unit according to claim 4, wherein
the frame part includes
a first side portion having a communication hole, wherein the second flow path is in communication with an outside of the flow path-defining member through the communication hole,
a second side portion facing the first side portion,
a third side portion forming a connection between one end of the first side portion and one end of the second side portion, and
a fourth side portion forming a connection between an other end of the first side portion and an other end of the second side portion,
the second side portion has a first recess recessed toward the first side portion at a midsection of the second side portion,
the third side portion has a second recess recessed toward the fourth side portion at a midsection of the third side portion,
the fourth side portion has a third recess recessed toward the third side portion at a midsection of the fourth side portion, and
an indentation depth of the first recess is greater than an indentation depth of the second recess and is greater than an indentation depth of the third recess.

7. The pump unit according to claim 1, further comprising an auxiliary heat-dissipating plate, the first plurality of piezoelectric pumps being sandwiched between the auxiliary heat-dissipating plate and the heat-dissipating plate.

8. The pump unit according to claim 1, wherein
the flow path-defining member has a first surface and a second surface facing each other, the heat-dissipating plate is a first heat-dissipating plate disposed on the first surface and a second heat-dissipating plate is disposed on the second surface,
the first plurality of piezoelectric pumps is disposed on a side on which the first surface is located, and
a second plurality of piezoelectric pumps is disposed on a side on which the second surface is located.

9. The pump unit according to claim 8, wherein at least one of the first plurality of piezoelectric pumps disposed on the side on which the first surface is located faces at least one of the second plurality of piezoelectric pumps disposed on the side on which the second surface is located.

10. The pump unit according to claim 8, wherein at least one of the first heat-dissipating plate and the second heat-dissipating plate partially extends beyond a periphery of the flow path-defining member.

11. The pump unit according to claim 8, wherein the flow path-defining member includes a frame part having one end portion side and an other end portion side and having a cavity opened from the one end portion side to the other end portion side, with the first surface being located on the one end portion side and the second surface being located on the other end portion side, the first heat-dissipating plate is disposed on the first surface in a manner so as to cover the cavity on the one end portion side, the second heat-dissipating plate is disposed on the second surface in a manner so as to cover the cavity on the other end portion side, and the first heat-dissipating plate and the second heat-dissipating plate, respectively, are fastened to the first surface and the second surface with a plurality of fastening members.

12. The pump unit according to claim 11, wherein the frame part includes a plurality of corner portions, and the first heat-dissipating plate and the second heat-dissipating plate are fastened on the plurality of corner portions to the first surface and the second surface, respectively.

13. The pump unit according to claim 11, wherein the frame part includes a first side portion having a communication hole, wherein the second flow path is in communication with an outside of the flow path-defining member through the communication hole, a second side portion facing the first side portion, a third side portion forming a connection between one end of the first side portion and one end of the second side portion, and a fourth side portion forming a connection between an other end of the first side portion and an other end of the second side portion, the second side portion has a first recess recessed toward the first side portion at a midsection of the second side portion, the third side portion has a second recess recessed toward the fourth side portion at a midsection of the third side portion, the fourth side portion has a third recess recessed toward the third side portion at a midsection of the fourth side portion, and an indentation depth of the first recess is greater than an indentation depth of the second recess and is greater than an indentation depth of the third recess.

14. The pump unit according to claim 8, further comprising:

a first auxiliary heat-dissipating plate, the at least one of the plurality of piezoelectric pumps disposed on the side on which the first surface is located being sandwiched between the first auxiliary heat-dissipating plate and the first heat-dissipating plate; and a second auxiliary heat-dissipating plate, the at least one of the plurality of piezoelectric pumps disposed on the side on which the second surface is located being sandwiched between the second auxiliary heat-dissipating plate and the second heat-dissipating plate.

15. The pump unit according to claim 1, wherein the flow path-defining member has a cut-out for exposing the heat-dissipating plate in a manner so as to face the flow path-defining member.

16. The pump unit according to claim 1, wherein the heat-dissipating plate partially extends beyond a periphery of the flow path-defining member.

17. The pump unit according to claim 3, wherein the flow path-defining member includes a frame part defining an open part, wherein the open part is opened toward a side on which the first plurality of piezoelectric pumps are located, the first surface is an end face on an end side of the frame part, and the heat-dissipating plate is disposed on the first surface in a manner so as to cover the open part and is fastened to the first surface with a plurality of fastening members.

* * * * *